US005181836A

United States Patent [19]

Zeitlin

[11] Patent Number: 5,181,836

[45] Date of Patent: * Jan. 26, 1993

[54] BEVERAGE FANNING DEVICE

[76] Inventor: Eric S. Zeitlin, 3059 Grand Ave., Baldwin, N.Y. 11510

[ * ] Notice: The portion of the term of this patent subsequent to May 26, 2009 has been disclaimed.

[21] Appl. No.: 726,695

[22] Filed: Jul. 8, 1991

Related U.S. Application Data

[63] Continuation-in-part of Ser. No. 486,812, Mar. 1, 1990, Pat. No. 5,115,566.

[51] Int. Cl.[5] ..... F04B 21/00

[52] U.S. Cl. ..... 417/313; 417/411; 99/290; 99/517

[58] Field of Search ..... 417/411, 313, 423.2, 417/423.7, 423.15; 30/142, 149, 150; 126/25 B; 99/290, 476, 517; 222/146.6

[56] References Cited

U.S. PATENT DOCUMENTS

| | | | |
|---|---|---|---|
| 1,026,904 | 5/1912 | Burke . | |
| 2,805,554 | 9/1957 | Schachtsiek . | |
| 2,900,808 | 8/1959 | Wang . | |
| 3,077,085 | 2/1963 | Johnston et al. . | |
| 3,647,323 | 3/1972 | Thomas | 417/234 |
| 3,840,153 | 10/1974 | Devlin | 222/146.6 |
| 4,034,897 | 7/1977 | Brown | 222/146.6 |
| 4,044,750 | 8/1977 | Zeigler | 126/25 B |
| 4,237,697 | 12/1980 | Cherbland | 62/293 |
| 4,734,017 | 3/1988 | Levin | 417/366 |
| 4,750,416 | 6/1988 | Graham | 99/476 |
| 4,765,152 | 8/1988 | Armstrong | 222/146.6 |
| 4,810,173 | 3/1989 | Thomson et al. | 417/411 |
| 4,817,509 | 4/1989 | Erickson | 99/476 |

*Primary Examiner*—Richard A. Bertsch
*Assistant Examiner*—Michael I. Kocharov

[57] ABSTRACT

An electrically actuated Libation Glatiation Device (Z) that may be removably secured to a food or liquid holding device (F), container, or the like, which will generate a draft in a desired direction that is of material assistance in cooling food or liquid held by the food or liquid holding device (F), container, or the like.

10 Claims, 6 Drawing Sheets

BEVERAGE FANNING DEVICE

This application is a continuation-in-part of U.S. patent application Ser. No. 07/486,812 "Food and Liquid Fanning Device," filed Mar. 1, 1990, by the present inventor, and allowed Jun. 19, 1991, now U.S. Pat. No. 5,115,566.

BACKGROUND—FIELD OF INVENTION

This invention relates to fanning devices, more specifically to a device used to fan beverages which are typically held in a cup, mug, bowl, or other non-utensil food or liquid holding device.

BACKGROUND—DESCRIPTION OF PRIOR ART

Heretofore, there has been no quick, easy, efficient and interesting way to cool hot foods or liquids conveniently while, for example, sitting at the dinner table after the food or liquid (i.e.; soup, coffee) has already been prepared and served.

Until now efforts to cool food or liquid that is too hot for the eater to eat has been limited to either putting ice in/on the hot food or liquid, blowing breath on the hot food or liquid by the eater, or just waiting until the hot food or liquid cools down sufficiently to enable comfortable ingestion.

These methods have many disadvantages which the present invention avoids:

1—Putting ice on/in the hot food or liquid causes food to get "soggy" and liquid to get "watered down".

2—Just waiting is time consuming and frustrating if the eater is either impatient, hungry, or in a rush, such frustration possibly leading to bad moods, strained relationships, fits of anger or high blood pressure and its related symptoms (i.e.; strokes or heart attacks).

3—Blowing breath on the hot food or liquid by the eater, probably the most common method used by eaters, contains such disadvantages as:

a—the stream of breath is intermittent due to the limited capacity of human lungs.

b—the stream of breath is not always accurate, sometimes missing the hot food or liquid altogether, thus providing an inefficient means of cooling and a less-than-optimal method of cooling given the amount of breath blown.

c—the eater may suffer adverse health effects from blowing his breath, such as dizziness, nausea, or fainting resulting from hyperventilation or hypoventilation.

d—because of reasons (a) and (b) discussed above, cooling of hot food or liquid takes longer than perhaps the eater wants to wait before ingesting his meal, leading to frustration and its ill-effects discussed above.

e—if the eater's breath is either misdirected or too forceful, the hot food or liquid being blown on can easily be blown off/out of its holding device (i.e.; bowl, cup, etc.) which can result in wasted food and liquids, leading to a further decreased world food supply and resulting starvation of the poorer peoples on earth as well as the decreased economic well being of the eater due to his own increased food costs. Furthermore, hot food or liquid that is blown off/out of its holder can be dangerous, leading to possible injuries such as scalding, burning, or injuries resulting from the fear of getting burned or scalded such as jumping incorrectly from one's chair or pulling a muscle from quick, jerky movements resulting from trying to withdraw ones body from the direction of the moving/flying hot food or liquid which has been blown off/out of its holder.

4—Present food and liquid holding devices are usually non-novel, increasing boredom while eating, resulting in a possibly less-than-exciting eating experience, and possible overeating by the eater due to the eater being bored.

The prior art contains many fanning devices, but none of these are made specifically for the fanning of food and liquids as the present invention is, nor do any of these prior art patents make any reference to their being used to that extent. Further, none of the prior art patents are designed for the same ease of use or towards simple, one-handed use as the present invention is. Additionally, none of the prior art patents contain the resilient "on" and "off" switch of the present invention which adds to ease of use.

Two examples of such fanning devices are Thomas' "Battery Operated Fanning Device", U.S. Pat. No. 3,647,323 and Zeigler's "Barbecue Blower" U.S. Pat. No. 4,044,750, both of which are designed to fan a fire or charcoal. Neither make any mention of being used to fan food or liquid nor do either mention that they may be modified to do so, showing that the present invention and its uses were unobvious to those skilled in the art. The present invention further distinguishes itself from these examples of the closest prior art in many other ways; for example, the resilient "on" and "off" switch of the present invention is easier to use than the on and off switches of the prior art in that it allows one-handed, even one fingered (the thumb) operation, whereas the prior art's switches are more complicated to switch on and off, and if used in the context or situation of the present invention would be likely to cause spillage or droppage of the food or liquid being held by the food or liquid holding device, as well as create a difficulty of use that might deter a potential user.

The present invention also provides better accuracy than the prior art, allowing the "aiming" of the stream of air exiting the device. Although Zeigler's device allows some aiming due to the ability of his device to tilt on its attaching mechanism, the present invention would allow up and down, side to side, and all angle movement at the top of the device and hence the "aiming" of the resulting stream of air. In addition, because the present invention allows flexibility closer to where the air is exiting, a greater accuracy can be expected than, for example, from Zeigler's device, which only allows flexibility at its base.

Further, the present invention is less obtrusive, because of its compact shape, than the prior art, and thus better suited for the situation that the present invention is designed for, namely the fanning of foods and liquids.

Finally, the present invention is similar to patent application Ser. No. 07/486,812, and would fall under the same prior art as the "Food and Liquid Fanning Device". Since the "Food and Liquid Fanning Device" has been held patentable over said prior art, the inventor contends that the present invention should likewise be held patentable over the prior art. Said prior art cited by Examiners Kocherov and Smith consist of the following:

The Burke U.S. Pat. No. 1,026,904 shows an electric motor with a fan attached to its front end.

The Levin U.S. Pat. No. 4,734,017 shows a hand-held air blower.

The Thomson et al U.S. Pat. No. 4,810,173 shows a firebooster used to fan fires, having an adjustable front sleeve.

The Zeigler U.S. Pat. No. 4,044,750 shows a barbeque blower having means to clip itself onto the rolled edge of a barbeque.

The Thomas U.S. Pat. No. 3,647,323, cited by applicant but not the Examiner, shows a battery operated fanning device for use with a barbeque.

The Inventor contends that because of these and other differences which will become obvious upon further inspection of the present invention, the present invention thus also distinguishes itself in its novelty over the prior art.

Further prior art has been cited to the present inventor, and may be relevant in this application, during the prosecution of patent application Ser. No. 07/602,406, the Comestable Cooling Device, which is a divisional application of patent application Ser. No. 07/486,812 (the Food and Liquid Fanning Device), filed Oct. 7, 1990 by the present inventor. That application is being handled by Examiner J. Sollecito of G. A. U. 344.

The following have been cited in the aforementioned application:

Cherbland U.S. Pat. No. 4,237,697 shows an apparatus for icing, freezing or frosting containers such as drinking glasses and the like. The present invention distinguishes over Cherbland because, besides having nothing to do with the cooling of foods or liquids, Cherbland does not show attaching means for attaching his device to a food or liquid holding device, only means for attachment to a container of gas. Further, Cherbland's device is large and obtrusive, and could not be easily modified for use similar to the use of the present invention.

Johnston et al U.S. Pat. No. 3,077,085 shows a hand-held liquid cooler. The present invention distinguishes over Johnston under Section 102 because Johnston shows no means of attachment whatsoever, letalone attaching means for attaching his device to a food or liquid holding device. Further, Johnston's device is heavy, since it is made of metal, has no switch means, and would be difficult to use in the present inventions capacity. Additionally, the fins on Johnston's device are located on the outside of the device and are used for increasing the surface area of the metal. The fins of the present invention are located on the inside of the device and are used to direct the draft of air.

Schachtsiek U.S. Pat. No. 2,805,554 shows an arrangement for cooling transportable goods, which includes two ramifications (FIGS. 8 & 9) showing a cooling device for attachment to the inside of a drinking glass. The present invention distinguishes over Schachtsiek because Schachtsiek's device could not be used in the present inventions capacity, and would be difficult and uncomfortable to use, as well as being very obtrusive. Additionally, although Schachtsiek's device could produce a draft of air over the food or liquid, it could not do so in the same capacity as the present invention because of the extreme variations in the design of the two inventions. Further, because Schachtsiek's device comes into actual contact with the liquid being cooled, hygienic concerns must be raised which the present invention avoids.

Wang U.S. Pat. No. 2,900,808 shows a hand-held liquid cooling device which is meant to be used as a cooling cup. The independent claim of the present invention (Claim 1) distinguishes over Wang under Section 102 because Wang shows no means of attachment for use with a food or liquid holding device. Further, Wang's device would be heavy, inconvenient, and obtrusive if used in the present inventions capacity.

The present invention also has the inherent benefit, lacking in the Wang patent, of being able to be used on almost any food or liquid holding device. Thus, the present invention can be used while dining without having to use a food or liquid holding device that does not match the rest of a set of dishes, for example.

OBJECTS AND ADVANTAGES

Accordingly, several objects and advantages of the present invention are:

1—to supply a compact device of simple mechanical structure, that is removably or permanently situated on a holder of food or liquids or other such similar devices, so that the unit, when activated, will blow a stream of air which can be directed onto, over, or around the food or liquid being held by the holder.

2—to provide a device which will bring more safety to the eating of hot foods and liquids by preventing such conditions as dizziness, nausea or fainting resulting from hyperventilation or hypoventilation, or other conditions resulting from unnatural breathing because of blowing breath on foods or liquids.

3—to provide a device which will add additional safety to the eating of hot foods and liquids by helping to prevent burns and scalding to the eater, caused by the ingestion of insufficiently cooled food or liquid (i.e.; a burnt tongue or throat) due to the eater using such inefficient cooling methods as described above.

4—to provide a device which will add additional safety to the eating of hot foods and liquids by helping to prevent burns and scalding to the eater due to falling hot food or liquid which may be blown off/out of its holder due to a misdirected or too forceful stream of breath, as well as pulled muscles or the like due to the same situation.

5—to provide a device which will add additional safety to the eating of hot foods and liquids by helping to eliminate some of the frustration and its resulting maladies from the eating of hot foods and liquids, as previously discussed, by providing a faster, more efficient way of cooling such hot foods or liquids than the present methods of cooling discussed above.

6—to provide a more enjoyable eating experience to an eater by preventing the burning of his taste buds from ingesting insufficiently cooled food or liquids, hence enabling the eater to taste his food or liquids fully.

7—to help protect the economic well being of an eater by helping to prevent unnecessary spillage or droppage of food or liquid due to a misdirected or too strong stream of breath, thus helping to keep his food costs as low as possible.

8—to help prevent the starvation of the poorer peoples of the earth by helping to prevent unnecessary spillage or droppage of food or liquid due to a misdirected or too strong stream of breath, thus helping to make sure no food or liquid is unnecessarily wasted.

9—to provide a device which helps reduce any additional need for cleaning tables, chairs, floors, and other surfaces of the dining area by helping to prevent unnecessary spillage or droppage of food or liquid due to a misdirected or too strong stream of breath onto any such dining area surfaces.

10—to provide a device which will provide faster means of cooling foods and liquids through its constant and more accurately directed stream of air which may be directed at or towards the food or liquid to be cooled.

11—to provide a device which is easy to use because of it's ability to be easily used with only one hand and at the simple push of a button.

12—to provide a more interesting device which will bring novelty to present food and liquid cooling methods. The present invention, especially if colored, painted, or otherwise made to be further pleasing to the eye, will help eliminate boredom of the user while eating, and thus will help extinguish boredom related symptoms such as overeating, feelings of depression, or fighting with ones dining companions.

13—to provide a device which will further help the user's human relationships by letting him talk with his dining companions if he so desires instead of having to use his breath to blow on his food or liquid.

14—to provide a device which will even further help the user's human relationships by helping to eliminate any potentially embarrassing situations to the user such as food or liquid being blown off/out of its holder as previously discussed and onto the user or the user's dining companions.

15—to provide a device which will provide a more reliable cooling means than the current methods, as long as the present invention's power supply is charged, since, for example, ice may melt or an eater may be out of breath, coughing, sneezing, or otherwise unable to blow breath on his food or liquid.

16—to provide a device which will provide a means of cooling food and liquids that is ecologically safe to the earth's atmosphere; contrasted to an eater simply blowing breath on his food or liquids, where the eater, since he is exhaling more than when he is not blowing breath onto his food or liquid, is thus putting more carbon dioxide, a major atmospheric pollutant, into the atmosphere than if he was using the present invention, which emits no more carbon dioxide than is already in the atmosphere.

17—to provide a device of greater accuracy and precision of cooling means than present cooling methods by providing an "on" and "off" button that can be instantly turned on or off by the user, as well as a constant stream of precisely directed air onto, over or around the food or liquid being cooled.

18—to provide a device which will be easily saleable because of its small size, ease of use, and universal need for such a device, as well as easy market penetration because of the nonexistence of similar devices in the present marketplace.

19—to provide a device which will provide excitement to both neophiles and laypersons alike through the present invention's newness and novelty.

20—to provide a device which will have a long product life cycle, since there will be a need for the present invention as long as there is a need to cool hot foods and liquids.

21—to provide a device which will help save energy by precluding the need to reheat foods or liquids that have overcooled because of the inaccuracy of present cooling methods (ie.: waiting too long for food or liquid to cool).

22—to provide a device which will not have to be extensively modified depending on the "handedness" of the user; the Libation Glaciation Device will work just as well for a user who is left-handed as one who is right-handed with only a slight modification to the device.

23—to provide a device which will be smaller than those in the prior art and less obtrusive, thus suiting the present invention to being attached to a food or liquid holding device, such as a coffee cup, without the present invention causing substantial weight to be added onto the coffee cup being held and also not causing inconvenience to the user because of any obtrusiveness of the device.

24—to provide a device which will be more stable when placed on a food or liquid holding device (ie.; a cup or bowl) by the inclusion of a stabilizer on the Libation Glaciation Device.

Still further objects and advantages will become apparent from a consideration of the ensuing description and drawings.

DRAWING FIGURES

REFERENCE NUMERALS IN DRAWINGS

Figure 1:
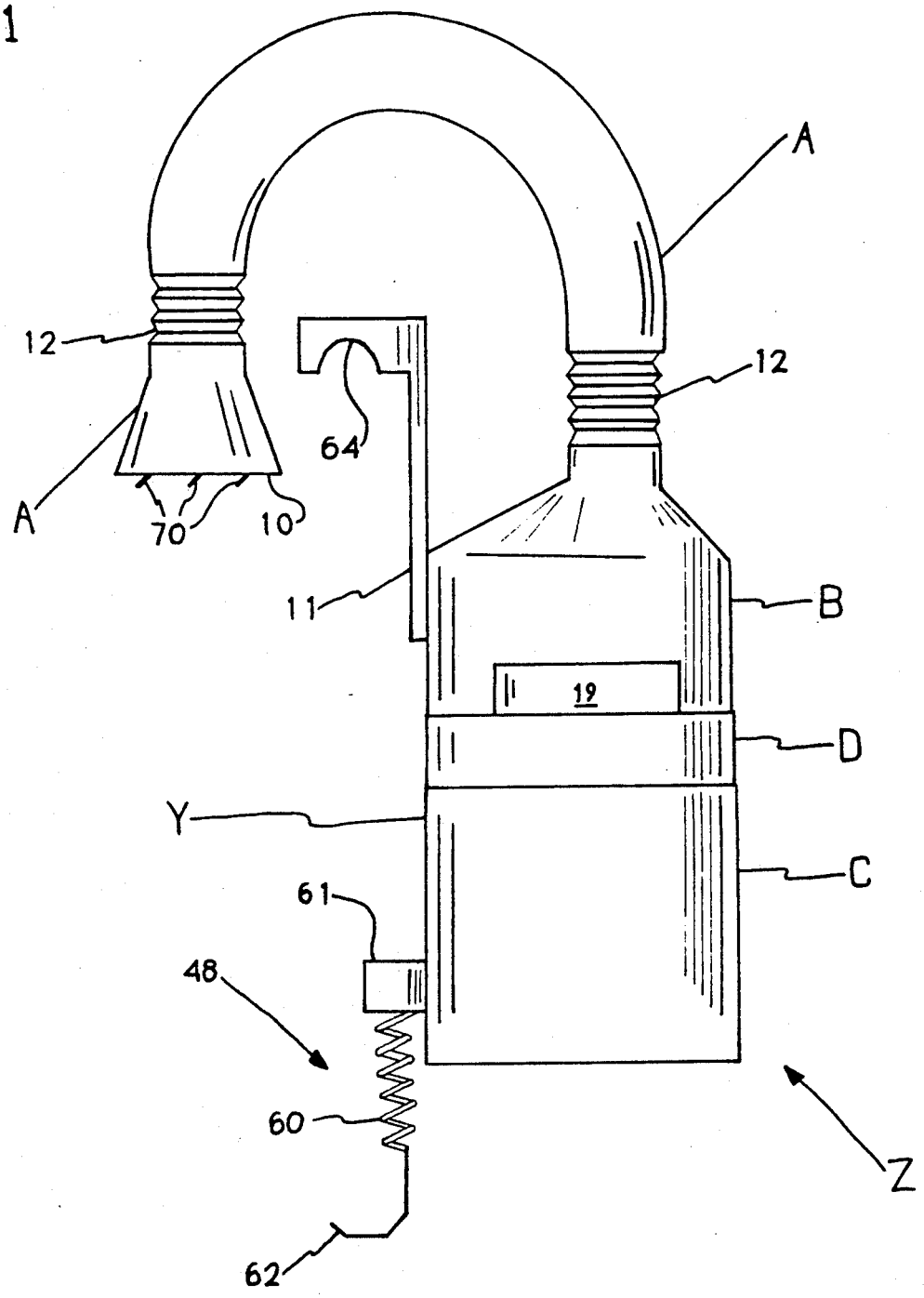
FIG. 1 is a side view of a Libation Glaciation Device (Z).

A—top housing part
B—second intermediate housing part
C—first intermediate housing part
D—screw-in housing part
E—longitudinal shaft assembly
F—a food or liquid holding device, here a cup with a handle
Y—entire housing of the Libation Glaciation Device
Z—The entire Libation Glaciation Device
10—opening at front of housing part (A)
11—attaching unit
12—flexible connecting material
15—metal plate
16—elongate shaft
17—electric motor
18—battery
19—"on" and "off" switch
20—column of electrically conductive material on switch (19)
21—electrically conductive insulated wire
22—wall in housing part (D)
23—commercially available springs
24—ring of electrically conductive material on tongue (27)
25—ring of electrically conductive material on inside of housing part (C)

26—electrically conductive insulated wire connecting battery to terminal plate 47
27—tongue of housing part (D)
28—top end of housing part (C)
29—screen
30—electrically conductive insulated wire connecting battery to terminal plate (46) via metal plate (15)
31—transverse spider
32—multi-bladed circular fan
33—air-intake opening
34—air passage
35—tongue of housing part (B)
36—recess of housing part (A)
39 and 39*a*—protrusions on switch (19)
40—head of elongate shaft (16)
41—spacer tube
42—spacer tube
43—hub of fan (32)
44—blades of fan (32)
45—transverse bore through hub (43)
46—terminal plate of motor (17)
47—second terminal of motor (17)
48—stabilizer
54—circular hole in the rear wall of housing part (D) which facilitates the insertion of switch (19) into part (D)
55—bore through tongue (27) for insertion of wire (21)
57—liquid held by cup (F)
60—commercially available spring
61—housing for commercially available spring (60)
62—clip or hook for securing the Libation Glatiation Device to the bottom of the food and liquid holding device (F)
64—notches of attaching unit (11)
65—rim of cup (F)
66—underside rim of cup (F)
70—directional fins

DESCRIPTION—FIGS. 1 to 6

A typical embodiment of the Libation Glaciation Device (Z), as illustrated in the drawings, includes an elongate housing (Y) formed by housing parts (A,B,C,D) that has at least one first open end (10) and at least one second opening which serves as an air intake (33), which openings are connected by an internal longitudinal passage (34).

Figure 2:
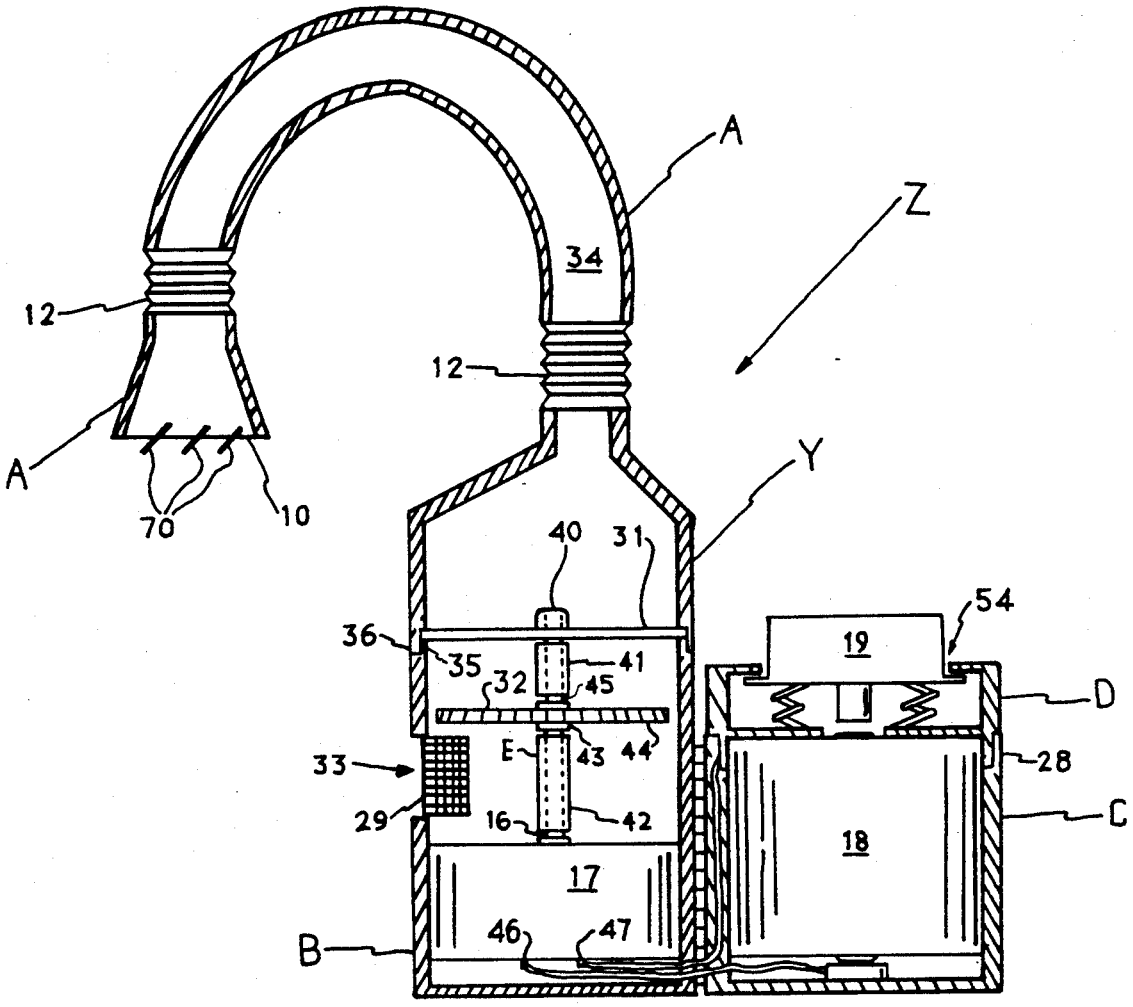
FIG. 2 is a cross sectional frontal view of the Libation Glaciation Device (Z).

FIG. 2 shows the housing (Y) having a transverse spider (31) located intermediate housing part (B) therein. A longitudinal shaft assembly (E) is disposed in the passage (34), with one end of the shaft assembly being supported by the spider (31) and the opposite end being carried by the electrically operated motor (17) which drives the shaft when activated. A multi-bladed circular fan (32) is provided that is rotatably supported on the shaft (E). The air intake (33) may have a screen (29) covering it or being attached underneath the air intake to the inside wall of the housing (Y) with suitable attaching means such as glue, adhesive, or the like.

Figure 3:
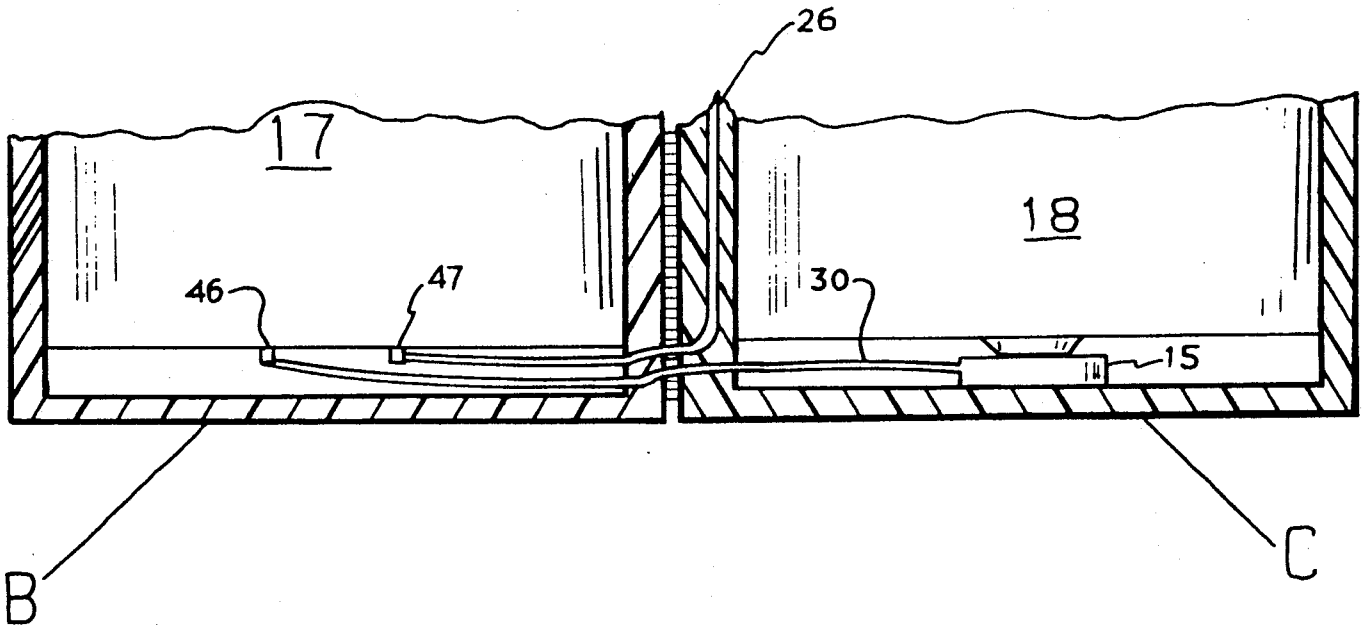
FIG. 3 is a fragmentary view of the bottom of FIG. 2, with battery (18) inserted therein, given in order to show that part of the Libation Glaciation Device (Z) in more detail.

The housing (Y) is preferably molded from a suitable polymerized resin, although any sturdy, lightweight material would be appropriate. Housing (Y) may be formed either as a whole integral unit or from multiple parts as shown here in the preferred embodiment. Housing parts (C) and (B) may be glued together, as in the preferred embodiment, or otherwise attached by other connecting means. The area of attachment between housing parts (B) and (C) is shown in FIGS. 1 and 3 as a broken line. Housing part (D) is not glued or attached to housing part (B) so that it may be removed from housing part (C) in order to replace the battery (18).

FIG. 2 shows the second section of the housing, part (B), having at its top end a recess (35) defined therein. Housing part (A) is also shown to have at its bottom end a tongue (36) which extends and engages the recess (35) of housing part (B). Housing parts (B) and (A) may be permanently secured to each other by conventional means such as glue, adhesive, or the like. The spider (31) is removably held in place within the confines of housing (Y) by having peripheral edge portions thereof engaged by circumferentially extending surfaces (35) and (36).

The shaft assembly (E), as may be seen in FIG. 2, includes an elongate shaft (16) that has a head (40) on the forward end thereof, and the shaft having the forward end portion rotatably mounted in a centrally disposed transverse opening defined in the spider (31). The shaft (16) on the forward portions thereof, has two spacer tubes (41,42) mounted thereon with the forward end of spacer tube (41) loosely abutting against the spider (31) and the rearward end of spacer tube (41) loosely abutting against the forward face of a hub (43) that forms a part of the fan (32), and from which hub a number of circumferentially spaced blades (44) project to draw air inwardly through air intake (33) and expel it through outlet opening (10) whenever motor (17) is actuated. The hub (43) has a transverse bore (45) extending therethrough. The bore (45) rotatably supports the fan (32) on the shaft (16). The forward end of spacer tube (42) is loosely abutted against the backward face of the hub (43) and the rearward end of spacer tube (42) is loosely abutted against the forward face of the electrically operated motor (17).

Figure 6:
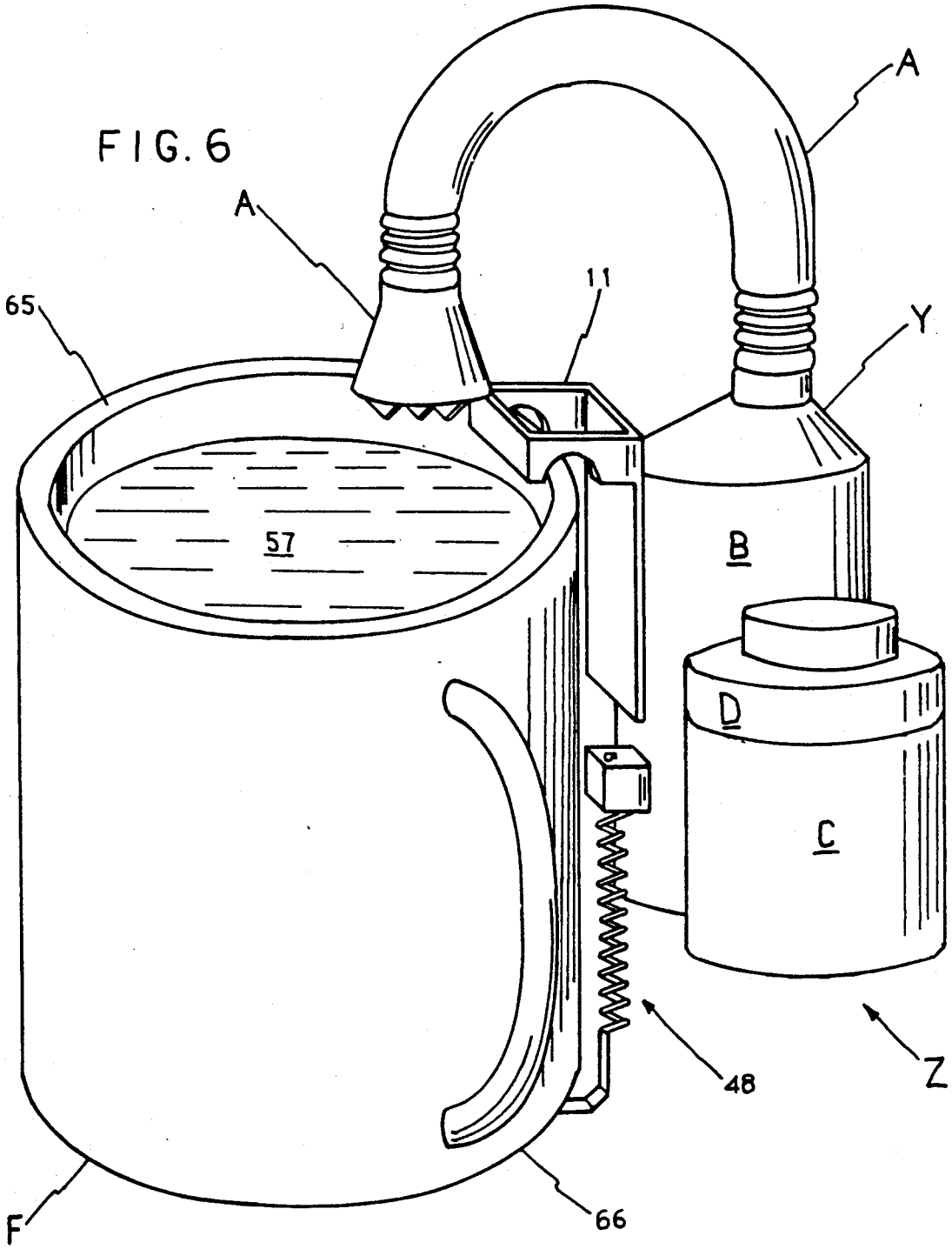
FIG. 6 is a perspective view of a Libation Glaciation Device (Z) attached to cup (F).

FIG. 6 shows how the housing (Y) may be removably supported on a food or liquid holding device, shown in the preferred embodiment as a cup with a handle (F). A means for securing housing (Y) to cup (F) is shown as an upwardly-extending attaching unit (11) which may be designed as part of housing (Y) or developed separately and secured to housing (Y) by conventional securing means. Housing (Y) may be secured temporarily (or permanently if desired) to cup (F) by placing the attaching unit (11) onto the rim (65) of cup (F) at the notches (64) of attaching unit (11). Thus a tight "grip" is created between the attaching unit (11) and cup (F), as shown in FIG. 6. Libation Glaciation Device (Z) is thus held in place on cup (F). Other conventional attaching means, such as clamps, glues, adhesives, magnets, and the like may also be used to secure housing (Y) to cup (F), but a non-permanent attaching means is preferred so that cleaning of the food or liquid holding device is easily facilitated once the Libation Glaciation Device (Z) is removed from it. Additionally, other food or liquid holding devices may be used in place of cup (F), such as mugs, bowls, glasses, and the like.

FIGS. 1, 2 and 6 show the housing (Y) containing an upwardly disposed portion (A) which has at it's front end at least one opening (10) and which is connected at it's back end to the upper portion of housing part (B). As shown, Housing part (A) can have a flexible material (12) such as rubber, or a thin, flexible, folded plastic (such as the kind used in common flexible plastic drinking straws), or the like, incorporated within segments of its walls which will allow the frontal portion (A) to be moved directionally and hold itself in that position, thus providing a draft in the desired direction.

Directional fins (70) can also be placed just inside the opening (10) of housing part (A) to further facilitate a smooth and directed flow of outflowing air. The fins shown in the preferred embodiment consist of long, thin, straight pieces of sturdy material, placed so that the exiting air is directed forward. This would allow the outflowing air to flow over the middle of the liquid held in cup (F) without having to place opening (10) directly over the middle of the liquid.

FIG. 2 shows housing (Y) containing an electric motor (17) which may be secured within housing (Y) by glue, adhesive, or other conventional securing means in order to help prevent motor (17) from moving within the housing (Y) or rotating therebetween. The motor (17) includes an conductive insulated wire (26) attached thereto at a terminal plate (47) located on the bottom face of motor (17) by soldering or the like. The opposite end of wire (26) is attached to and in continuous electrical contact with a thin ring of electrically conductive material (25) which is secured to and circumvents the back end of the inside wall of housing part (C) right before the threads on its rearward end (28) on housing part (C). This is more clearly shown in FIGS. 3 and 4. Similarly, electrically conductive wire (30) is attached to motor (17) via terminal plate (46), with the opposite end of wire (30) being attached to and in continuous electrical contact with metal plate (15), whereby the bottom end of battery (18) is electrically connected to motor (17). This is more clearly shown in FIG. 3.

FIGS. 2 and 3 show how screw-in housing part (D) is designed to hold a removable and replaceable battery (18) in place inside housing parts (C) and (D) so that the central terminal of battery (18) is in fixed electrical contact with metal plate (15). The battery (18) is held in place and in engagement with the aforementioned metal plate (15) by having its upper face being in pressured contact with wall (22) protruding from housing part (D). Note that FIGS. 2 and 3 show battery (18) inserted in housing (Y), whereas FIG. 4 shows housing (Y) without a battery (18) inserted therein.

Figure 4:
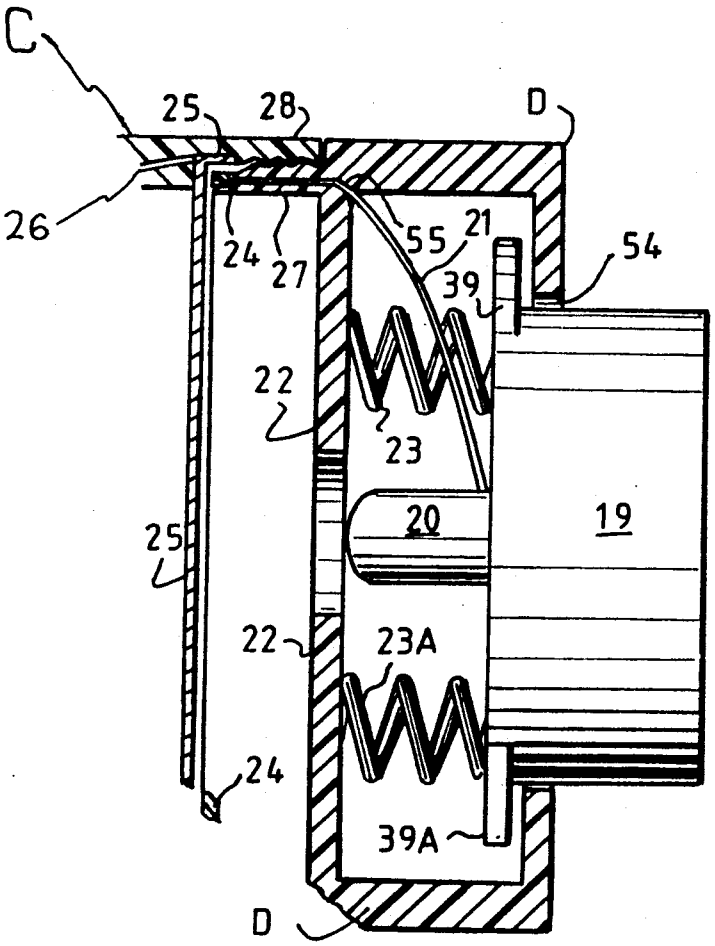
FIG. 4 is a fragmentary view of part of the top of FIG. 2, without battery (18) inserted therein, given in order to show that part of the Libation Glaciation Device (Z) in more detail.

FIGS. 2 and 4 show housing part (D) enclosing the front end of a horizontally movable "on" and "off" switch (19) which extends through a circular opening (54) in the top wall of housing part (D) and which is held in the "off" position by a number of commercially available springs (23) that are abutted against the bottom face of switch (19). Protrusions (39 and 39*a*) located on switch (19) prevent the switch (19) from being pushed beyond housing part (D) by said springs. Other resilient material may be used in place of said springs, such as rubber, plastics, or the like. Springs (23) are abutted on their opposite ends against the top face of wall (22).

FIGS. 2 and 4 illustrate how a battery (18) may be installed or removed from housing (Y) through an opening in the top of housing part (C). To this extent the inner wall of housing part (C) is provided with threads at its top end (28) that cooperate with the external threads on tongue (27) of housing part (D). When housing part (D) is inserted and "screwed into" housing part (C) [i.e.: part D is inserted into part C and rotated manually until a snug fit is achieved; or, similarly, upon the full cooperation of the internal and external threads] the conductive ring (25) on the inside of housing part (C) comes into physical contact and forms an electrically conductive contact with a similar ring of electrically conductive material (24) located on the outside front of tongue (27) of housing part (D).

FIGS. 2 and 4 indicate the location of a column of electrically conductive material [i.e.: most types of solid metals could be used for such a column] (20) extending vertically downward from the center of the bottom face of switch (19) and held in place on switch (19) by glue, adhesive, a commercially available screw, or other conventional securing means. Attached to column (20) by soldering or the like is at least one electrically conductive insulated wire (21), said wire at its other end, after passing through a bore (55) in the tongue (27), being connected, by soldering or the like, and in continuous electrical contact with the aforementioned ring of electrically conductive material (24) on the outside of tongue (27) of housing part (D), as shown more clearly in FIG. 4. The tip of column (20) is generally rounded and is adapted to come into contact with the top face of battery (18) when switch (19) is made to move downward [i.e.: pushed down] vertically into the housing part (D) by the user. Hence, the movement of switch (19) vertically upward or downward through opening (54) will cause column (20) to also move vertically into or out of, respectively, a circular hole in the center of wall (22) of housing part (D), thus selectively energizing fan (32) through the activation of motor (17), as will be more fully discussed below. When switch (19) is moved vertically into housing part (D), causing also column (20) to move downward through said hole in wall (22), the aforementioned tip of column (20) will be caused to come into physical contact and hence an electrically conducting contact with the top face of battery (18). When switch (19) is released, causing it to move vertically out of housing part (D), column (20) will also move horizontally back through the hole in wall (22) causing the physical contact and hence the electrical contact to be broken between column (20) and battery (18).

Since the central terminal of battery (18) is in constant contact with motor (17) via metal plate (15), energization of the electric motor (17) and the consequent energization of fan (32) occurs upon the aforementioned physical and electrical contact of column (20) with the central terminal at the top of battery (18). Said contact will cause electricity to flow from battery (18) through column (20), then through wire (21), the electric current continuing on through conductive material (24) and then onwards through conductive material (25), said current finally flowing through wire (26) and into motor (17) at terminal plate (47) on the motor (17), thus completing the electric circuit into motor (17) and energizing said motor and fan (32). As mentioned previously, release of switch (19) and the subsequent retraction away from battery (18) of said switch caused by the expansion of the now contracted springs (23) will result in a breaking of the previously completed electric current and hence the deactivation of motor (17) and fan (32).

Figure 5:
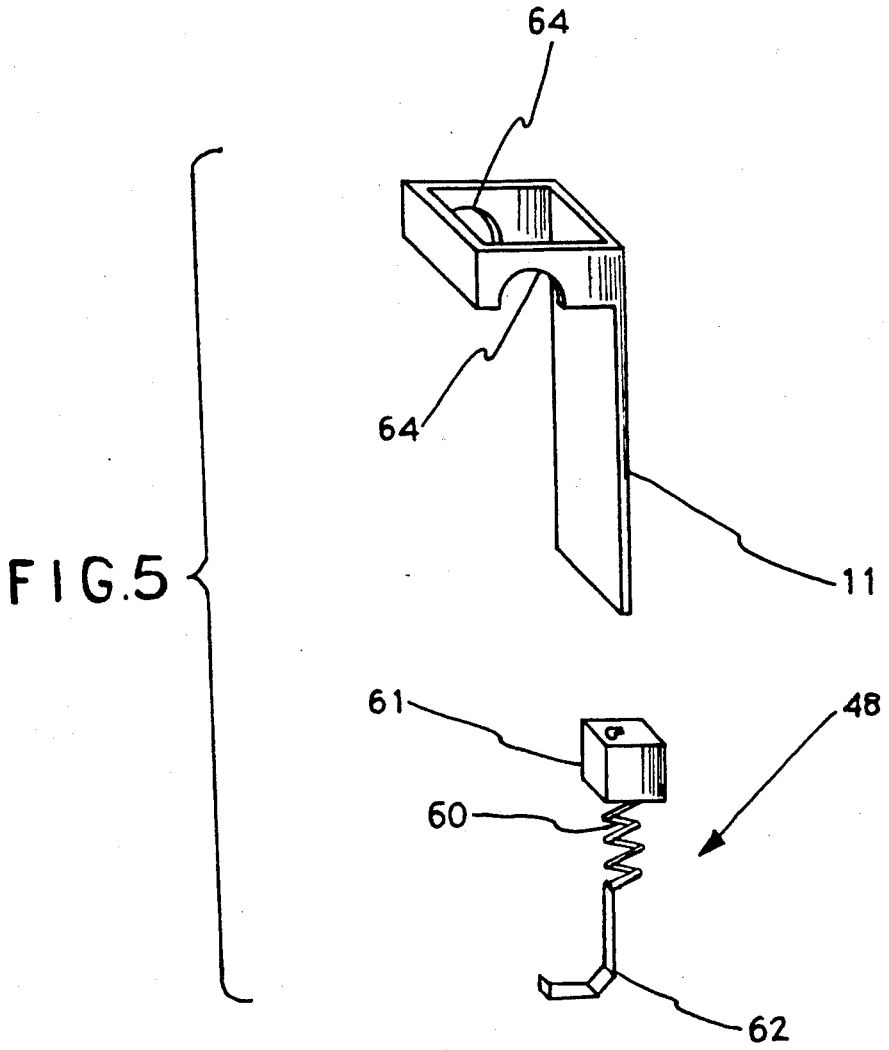
FIG. 5 shows a fragmentary perspective view of the attaching unit (11) and stabilizing device.

FIGS. 1, 5 and 6 also show the stabilizer (48) located towards the bottom of housing (Y) underneath the attaching unit (11). The purpose of the stabilizer is to prevent the Libation Glaciation Device from moving when it is attached to cup (F) or other food or liquid holding device.

Attaching unit (11) and/or stabilizer (48) can be located on either housing part (B) or housing part (C). Similarly, more than one attaching unit (11) and/or stabilizer (48) can be used.

FIGS. 1, 5 and 6 show the make-up of stabilizer (48) in the preferred embodiment, consisting of commercially available spring (60), spring housing (61), and clip or hook (62) for securing the Libation Glatiation Device to the underside rim (66) of cup (F). The stabilizer works as follows: After the Libation Glatiation Device is placed on the rim of cup (F) via attaching unit (11), clip (62) is pulled downwards, stretching spring (60), and hooked onto the underside rim (66) of cup (F), as shown in FIG. 6. This will help keep the Libation Glatiation Device secure on cup (F) when the Libation Glatiation Device is activated. Clip (62) can be made of sturdy material such as metal or a strong plastic, and should resemble a hook, as indicated in the drawings. Spring (60) is attached to the top of the spring housing (61) and the top of the clip (62). Spring (60) is partially housed inside spring housing (61), as shown in FIGS. 1, 5 and 6.

While this invention has been described with reference to a particular embodiment thereof, it is apparent that many other forms and embodiments thereof will be obvious to those skilled in the art in view of the foregoing disclosure. Thus, the scope of the invention should be determined not by the embodiments illustrated, but by the appended claims and their legal equivalents.

OPERATION OF INVENTION

The use and operation of the present invention is very simple. The invention (Z), as described in the preferred embodiment above, is first mounted on a food or liquid holding device, container or the like, here a cup (F), by means of a connecting device, here a hanging attaching unit (11). The motor (17) is actuated by the user pushing the switch (19) downward into the housing (Y), in this case through the user pushing and holding the switch (19) with their finger, most appropriately their thumb if the cup is held in a conventional way, while holding a cup with the Libation Glatiation Device (Z) attached to it. When the user no longer desires a draft flowing onto the contents of the cup, shown here as hot coffee (57), they simply release any pressure that their thumb is putting on the switch (19) and let the switch (19) spring back to its original "off" position.

When the switch (19) is pushed downward, motor (17) is actuated, causing shaft (16) to rotate and hence the rotation of fan (32), which causes air to be drawn into the passage (34) through the air intake (33) and subsequently discharged out of the housing (Y) through opening (10) in housing part (A), as previously described in the Description of Invention.

The direction of the discharged volume of air can be altered by manually moving the front housing part (A) into the desired position which will effectuate the directing of the discharged flow of air, as previously described.

The present invention can easily be modified and adapted to be used on a variety of food and/or liquid holding devices, such as dishes, coffee mugs, glasses, bowls, or any other conventional food or liquid holding device. The Libation Glatiation Device (Z) can be used whenever and whereever the user desires a stream of air to be directed onto their food or liquid, being especially easy and convenient to use.

SUMMARY, RAMIFICATIONS, AND SCOPE

Thus, the reader will see that the present invention, the Libation Glatiation Device, provides a reliable, lightweight, efficient and easy-to-use device bringing such possible benefits as safety, protected health, more enjoyable meals, excitement, cleanliness, and others previously mentioned to the environment, the user, and anyone in close proximity to the user.

While the above description contains many specificities, these should not be construed as limitations on the scope of the invention, but rather as an exemplification of one preferred embodiment thereof. Many other variations are possible, for example:

1—A motor whose speed of rotation is variable and adjustable may be used, with adjusting means enabling the user to adjust the speed of the motor manually.

2—The front opening (10) may be made adjustable in order to facilitate different types and consistencies of different foods or liquids, and similarly may be of any radius or diameter.

3—Compressed or otherwise contained air may be used instead of air from the immediate environment, with such containers of air being connected to the Libation Glatiation Device sufficiently to enable the contained air to flow into the Libation Glatiation Device for subsequent expulsion by the fan (32). Further, the contained air may be refrigerated or otherwise be made to be cooler than atmospheric air. Or, air need not be used at all, and instead other gases such as freon, carbon dioxide, or the like, which will most likely be contained in a container, may be used in its place.

4—Similarly, no fan need be included at all in the invention, instead relying on the compression of air or other gases which are contained in a container and the force of that compression serving to force the air or gas out in the form of a draft, said container being mounted either on, within, or separately from the housing (Y) of the Libation Glatiation Device and with its opening connected into the Libation Glatiation Device. A typical embodiment of this ramification would be to make the housing able to accommodate a thin container of compressed gas, with a switch on the housing and opening means upon which the activation thereof of said switch will cause the opening means to open said gas containing container. This opening of said container causing said contained gas to be released into the housing and subsequently expelled, through its own force of expulsion from said container, first into and then out of the Libation Glatiation Device and onto or around the food or liquid holding device or the like, as well as onto or around any food or liquid said food or liquid holding device may be holding.

5—The power source can be located elsewhere than inside the Libation Glatiation Device, i.e.: in the food or liquid holding device itself, plugged into a wall socket or converter, or the like.

6—The power source can be non-electrical, i.e.: a spring actuated motor, solar power cells, hand or finger operated, or the like.

7—The switch can be located elsewhere on the device, such as the front or side of the Libation Glatiation Device, or not on the device at all and instead located on a remote control, on the handle of a cup or on/in the cup itself, or similar place.

8—The switch can be made to have the ability to be temporarily locked in either the "on" position or the "off" position through the use of locking means.

9—The Libation Glatiation Device may be attached either temporarily or permanently onto the food or liquid holding device and may be held in place there by any conventional securing means [including means capable of directional adjustment], such as a snap-on device, magnets, slip-in device, lock-on device, tape, glue, adhesive, slide-on device, twist-on device, screw-on device, clamp, or the like.

10—The Libation Glatiation Device can be made of any type of material, including metals, plastics, rubber, or any other suitable material.

11—The Libation Glatiation Device can be made with an air intake cover, or may utilize other regulating means to regulate the inflow or outflow of air.

12—The Libation Glatiation Device can be used with any food or liquid holding device or container.

13—The housing of the Libation Glatiation Device may be in any shape, such as rectangular, square, or the like.

14—There may be no screen used to cover the opening (33) on the side of the Libation Glatiation Device, or similarly a screen or suitable mesh-like material may be used to cover the opening (10) of the Libation Glatiation Device.

15—The Libation Glatiation Device can be made so that the battery can be inserted and used in the reverse of the position shown in the preferred embodiment in order to save space inside the Libation Glatiation Device.

16—There may be more than one air-intake opening, and similarly there may be more than one front opening (10).

17—The front housing part (A) can be immovably attached to housing part (B) so that there would exist no capability for flexibility [i.e.: no flexible material at (12)].

18—The Libation Glatiation Device can be made to be free standing.

19—The Libation Glatiation Device can be colored in any way or similarly designed for a pleasing visual experience.

20—More than one fan can be used inside the Libation Glatiation Device.

21—The switch (19) can be made hollow and "squeezable" in order to facilitate the insertion of switch (19) into housing part (D) after part (D) has been manufactured; this can then be easily done by squeezing the sides of the switch, inserting said switch into part (D), and then "unsqueezing," or letting the switch reform into its original shape.

22—Similarly, the back wall of housing part (D) can have notches included at the outer rim of circular hole (54) in part (D) which could be the same size as protrusions (39 and 39*a*) on switch (19). Thus switch (19) can be inserted into part (D) by lining up protrusions (39 and 39*a*) at said notches and pushing switch (19) into part (D), and then turning the switch (19) clockwise or counterclockwise so that the protrusions are no longer lined up with said notches.

23—The Libation Glatiation Device can be made to be waterproof in order to protect it from any spillage of liquid into or onto the Libation Glatiation Device.

24—Cooling coils, refrigeration coils, or similar cooling means may be included in the inside of housing (Y), such that when air is drawn into housing (Y) and into the air passage (34), said air will come into contact with the cooling means resulting in said air becoming cooler than it was before entering housing (Y), and hence will be cooler than the atmospheric air upon discharge from housing (Y) through front opening (10).

25—Other types of stabilizers may be attached to the housing (Y) in order to keep the Libation Glatiation Device steady and unmoving when it is attached to a food or liquid holding device (as described in the description).

26—The Libation Glatiation Device's shape may be modified in relation to the food or liquid holding device it is designed to be used with; i.e.: the housing (Y) may be designed in a "V" shape, or part of the Libation Glatiation Device can lie horizontally, in order to fit more compactly on a soup bowl, for example.

27—The Libation Glatiation Device can have a switch extension attached to switch (19), in order to facilitate easier access to switch (19) by the user. Such a switch extension can be placed over switch (19), allowing the user easier access to switch (19) and thus easier use of the Libation Glatiation Device.

28—The Libation Glatiation Device can be otherwise made so that space may be saved lengthwise, heightwise, or widthwise, such as by designing the housing so that the battery or motor are adjacent to, above, below, etc. the rest of the Libation Glatiation Device.

29—The Libation Glatiation Device can be made so that the attaching device (11) and stabilizer (48) are rotatable around housing (Y), so that the Libation Glatiation Device is easily modified for use by a left-handed user.

30—The Libation Glatiation Device can be made so that the attaching device (11) consists of a ring of material which tightly circumvents the food or liquid holding device.

31—The Libation Glatiation Device can be made so that the attaching device (11) and stabilizer (48) are modified to the shape of the food or liquid holding device upon which it is to be used.

32—Wires (26), (30), and/or (21) can be substituted with other electrically conductive material, such as a metal strip.

Accordingly, the scope of the invention should not be solely determined by the embodiment illustrated, but by the appended claims and their legal equivalents.

I claim:

1. A combination cup and fan comprising:

a cup;

a fan means contained in a fan housing for providing a draft of air; and attachment means securing said fan housing to a side of said cup.

2. A combination cup and fan as defined in claim 1 wherein said fan means is further comprised of:

(a) at least one multi-bladed fan disposed in said fan housing being operably connected to a prime mover;

(b) powering means, whereby power is provided to said prime mover;

(c) switch means, whereby said prime mover may be selectively actuated.

3. A combination cup and fan as defined in claim 2 further including said prime mover having speed changing means which may be manually changed by a user and will result in a variance in the speed of rotation of the driveshaft of said prime mover.

4. A combination cup and fan as defined in claim 1, further including stabilizing means attached to said fan housing, whereby said fan housing may be held steadily on said cup.

5. A combination cup and fan as defined in claim 2, further including said switch means being resilient.

6. A combination cup and fan as defined in claim 2 further including said switch means having the ability to lock in place.

7. A combination cup and fan as defined in claim 2, further including said powering means being comprised of an electrical dry-cell battery.

8. A combination cup and fan as defined in claim 1 further including adjusting means for varying the open area of the air-intake of said fan housing, whereby the effective area of said air-intake may be changed.

9. A combination cup and fan as defined in claim 1 wherein a flexible material is incorporated into a limited portion of the outer wall of said fan housing, whereby said draft may be directed in a more accurate direction.

10. A combination cup and fan as defined in claim 1 further including said attachment means being temporary attachment means for removably attaching said fan housing to said cup.

* * * * *